US005845244A

United States Patent [19]

Proust

[11] Patent Number: 5,845,244

[45] Date of Patent: Dec. 1, 1998

[54] ADAPTING NOISE MASKING LEVEL IN ANALYSIS-BY-SYNTHESIS EMPLOYING PERCEPTUAL WEIGHTING

[75] Inventor: Stéphane Proust, Lannion, France

[73] Assignee: France Telecom, Paris, France

[21] Appl. No.: 645,388

[22] Filed: May 13, 1996

[30] Foreign Application Priority Data

May 17, 1995 [FR] France ..... 95 05851

[51] Int. Cl.[6] ..... G10L 9/14

[52] U.S. Cl. ..... 704/220; 704/223; 704/219

[58] Field of Search ..... 395/2.09, 2.25–2.32, 395/2.38, 2.39, 2.37; 704/200, 216–223, 226–230

[56] References Cited

U.S. PATENT DOCUMENTS

| | | | |
|---|---|---|---|
| 4,932,061 | 6/1990 | Kroon et al. | 395/2.32 |
| 5,265,167 | 11/1993 | Akamine et al. | 395/2.29 |
| 5,293,449 | 3/1994 | Tzeng | 395/2.32 |
| 5,307,441 | 4/1994 | Tzeng | 395/2.31 |
| 5,321,793 | 6/1994 | Drogo De Iacovo et al. | 395/2.29 |
| 5,371,853 | 12/1994 | Kao | 395/2.32 |
| 5,574,825 | 11/1996 | Chen et al. | 395/2.37 |
| 5,615,298 | 3/1997 | Chen | 395/2.37 |

FOREIGN PATENT DOCUMENTS

| | | | |
|---|---|---|---|
| 0 503 684 A2 | 9/1992 | European Pat. Off. | G10L 9/14 |
| 0 573 216 A3 | 12/1993 | European Pat. Off. | G10L 9/14 |
| 0 582 921 A3 | 2/1994 | European Pat. Off. | G10L 9/14 |

OTHER PUBLICATIONS

Atal et al., "Predictive Coding of Speech Signals and Subjective Error Criteria," *IEEE Transactions on Acoustics, Speech and Signal Processing* 27:3, 1979, pp. 247–254.

Chen et al., "Real–Time Vector APC Speech Coding at 4800 BPS with Adaptive Postfiltering," *IEEE,* 1987, pp. 2185–2188.

Saoudi et al., "A New Efficient Algorithm to Compute the LSP Parameters for Speech Coding," *Signal Processing* 28, 1992, pp. 201–212.

Cuperman et al., "Low Delay Speech Coding," *Speech Communication* No. 2, Jun. 1993, pp. 193–204.

*Primary Examiner*—David D. Knepper
*Attorney, Agent, or Firm*—Oliff & Berridge, PLC

[57] ABSTRACT

In an analysis-by-synthesis speech coder employing a short-term perceptual weighting filter with transfer function $W(z) = A(z/\gamma_1)/A(z/\gamma_2)$, the values of the spectral expansion coefficients $\gamma_1$ and $\gamma_2$ are adapted dynamically on the basis of spectral parameters obtained during short-term linear prediction analysis. The spectral parameters serving in this adaptation may in particular comprise parameters representative of the overall slope of the spectrum of the speech signal, and parameters representative of the resonant character of the short-term synthesis filter.

7 Claims, 2 Drawing Sheets

ADAPTING NOISE MASKING LEVEL IN ANALYSIS-BY-SYNTHESIS EMPLOYING PERCEPTUAL WEIGHTING

BACKGROUND OF THE INVENTION

The present invention relates to the coding of speech using techniques of analysis by synthesis.

An analysis-by-synthesis speech coding method ordinarily comprises the following steps:

- linear prediction analysis of order p of a speech signal digitized as successive frames in order to determine parameters defining a short-term synthesis filter;
- determination of excitation parameters defining an excitation signal to be applied to the short-term synthesis filter in order to produce a synthetic signal representative of the speech signal, some at least of the excitation parameters being determined by minimizing the energy of an error signal resulting from the filtering of the difference between the speech signal and the synthetic signal by at least one perceptual weighting filter; and
- production of quantization values of the parameters defining the short-term synthesis filter and of the excitation parameters.

The parameters of the short-term synthesis filter which are obtained by linear prediction are representative of the transfer function of the vocal tract and characteristic of the spectrum of the input signal.

There are various ways of modelling the excitation signal to be applied to the short-term synthesis filter which make it possible to distinguish between various classes of analysis-by-synthesis coders. In most current coders, the excitation signal includes a long-term component synthesized by a long-term synthesis filter or by the adaptive codebook technique, which makes it possible to exploit the long-term periodicity of the voiced sounds, such as the vowels, which is due to the vibration of the vocal chords. In CELP coders ("Code Excited Linear Prediction", see M. R. Schroeder and B. S. Atal: "Code-Excited Linear Prediction (CELP): High Quality Speech at Very Low Bit Rates", Proc. ICASSP'85, Tampa, March 1985, pages 937–940), the residual excitation is modelled by a waveform extracted from a stochastic codebook and multiplied by a gain. CELP coders have made it possible, in the usual telephone band, to reduce the digital bit rate required from 64 kbits/s (conventional PCM coders) to 16 kbits/s (LD-CELP coders) and even down to 8 kbits/s for the most recent coders, without impairing the quality of the speech. These coders are nowadays commonly used in telephone transmissions, but they offer numerous other applications such as storage, wideband telephony or satellite transmissions. Other examples of analysis-by-synthesis coders to which the invention may be applied are in particular MP-LPC coders (Multi-Pulse Linear Predictive Coding, see B. S. Atal and J. R. Rende: "A New Model of LPC Excitation for Producing Natural-Sounding Speech at Low Bit Rates", Proc. ICASSP'82, Paris, May 1982, Vol. 1, pages 614–617), where the residual excitation is modelled by variable-position pulses with respective gains assigned thereto, and VSELP coders (Vector-Sum Excited Linear Prediction, see I. A. Gerson and M. A. Jasiuk, "Vector-Sum Excited Linear Prediction (VSELP) Speech Coding at 8 kbits/s", Proc. ICASSP'90 Albuquerque, April 1990, Vol. 1, pages 461–464), where the excitation is modelled by a linear combination of pulse vectors extracted from respective codebooks.

The coder evaluates the residual excitation in a "closed-loop" process of minimizing the perceptually weighted error between the synthetic signal and the original speech signal. It is known that perceptual weighting substantially improves the subjective perception of synthesized speech, with respect to direct minimization of the mean square error. Short-term perceptual weighting consists in reducing the importance, within the minimized error criterion, of the regions of the speech spectrum in which the signal level is relatively high. In other words, the noise perceived by the hearer is reduced if its spectrum, a priori flat, is shaped in such a way as to accept more noise within the formant regions than within the inter-formant regions. To achieve this, the short-term perceptual weighting filter frequently has a transfer function of the form $$W(z)=A(z)/A(z/\gamma)$$

where $$A(z) = 1 - \sum_{i=1}^{p} a_i z^{-i}$$

the coefficients $a_i$ being the linear prediction coefficients obtained in the linear prediction analysis step, and $\gamma$ denotes a spectral expansion coefficient lying between 0 and 1. This form of weighting has been proposed by B. S. Atal and M. R. Schroeder: "Predictive Coding of Speech Signals and Subjective Error Criteria", IEEE Trans. on Acoustics, Speech, and Signal Processing, Vol. ASSP-27, No. 3, June 1979, pages 247–254. For $\gamma=1$, there is no masking: minimization of the square error is carried out on the synthesis signal. If $\gamma=0$, masking is total: minimization is carried out on the residual and the coding noise has the same spectral envelope as the speech signal.

A generalization consists in choosing for the perceptual weighting filter a transfer function W(z) of the form $$W(z)=A(z/\gamma_1)/A(z/\gamma_2)$$

$\gamma_1$ and $\gamma_2$ denoting spectral expansion coefficients such that $0 \leqq \gamma_2 \leqq \gamma_1 \leqq 1$. See J. H. Chen and A. Gersho: "Real-Time Vector APC Speech Coding at 4800 Bps with Adaptive Postfiltering", Proc. ICASSP'87, April 1987, pages 2185–2188. It should be noted that masking is absent when $\gamma_1=\gamma_2$ and total when $\gamma_1=1$ and $\gamma_2=0$. The spectral expansion coefficients $\gamma_1$ and $\gamma_2$ determine the desired level of noise masking. Masking which is too weak makes constant granular quantization noise perceptible. Masking which is too strong affects the shape of the formants, the distortion then becoming highly audible.

In the most powerful current coders, the parameters of the long-term predictor, comprising the LTP delay and possibly a phase (fractional delay) or a set of coefficients (multi-tap LTP filter), are also determined for each frame or sub-frame, by a closed-loop procedure involving the perceptual weighting filter.

In certain coders, the perceptual weighting filter W(z), which exploits the short-term modelling of the speech signal and provides for the formant distribution of the noise, is supplemented with a harmonic weighting filter which increases the energy of the noise in the peaks corresponding to the harmonics and diminishes it between these peaks, and/or with a slope correction filter intended to prevent the appearance of unmasked noise at high frequency, especially in wideband applications. The present invention is mainly concerned with the short-term perceptual weighting filter W(z).

The choice of the spectral expansion parameters $\gamma$, or $\gamma_1$ and $\gamma_2$, of the short-term perceptual filter is ordinarily optimized with the aid of subjective tests. This choice is subsequently frozen. However, the applicant has observed that, according to the spectral characteristics of the input signal, the optimal values of the spectral expansion parameters may undergo a sizeable variation. The choice made therefore constitutes a more or less satisfactory compromise.

SUMMARY OF THE INVENTION

A purpose of the present invention is to increase the subjective quality of the coded signal by better characterization of the perceptual weighting filter. Another purpose is to make the performance of the coder more uniform for various types of input signals. Another purpose is for this improvement not to require significant further complexity.

The present invention thus relates to an analysis-by-synthesis speech coding method of the type indicated at the start, in which the perceptual weighting filter has a transfer function of the general form $W(z)=A(z/\gamma_1)/A(z/\gamma_2)$ as indicated earlier, and in which the value of at least one of the spectral expansion coefficients $\gamma_1$, $\gamma_2$ is adapted on the basis of the spectral parameters obtained in the linear prediction analysis step.

Making the coefficients $\gamma_1$ and $\gamma_2$ of the perceptual weighting filter adaptive makes it possible to optimize the coding noise masking level for various spectral characteristics of the input signal, which may have sizeable variations depending on the characteristics of the sound pick-up, the various characteristics of the voices or the presence of strong background noise (for example car noise in mobile radiotelephony). The perceived subjective quality is increased and the performance of the coder is made more uniform for various types of input.

Preferably, the spectral parameters on the basis of which the value of at least one of the spectral expansion coefficients is adapted comprise at least one parameter representative of the overall slope of the spectrum of the speech signal. A speech spectrum has on average more energy in the low frequencies (around the frequency of the fundamental which ranges from 60 Hz for a deep adult male voice to 500 Hz for a child's voice) and hence a generally downward slope. However, a deep adult male voice will have much more attenuated high frequencies and therefore a spectrum of bigger slope. The prefiltering applied by the sound pick-up system has a big influence on this slope. Conventional telephone handsets carry out high-pass prefiltering, termed IRS, which considerably attenuates this slope effect. However, a "linear" input made in certain more recent equipment by contrast preserves all of the importance of the low frequencies. Weak masking (a small gap between $\gamma_1$ and $\gamma_2$) attenuates the slope of the perceptual filter too much as compared with that of the signal. The noise level at high frequency remains large and becomes greater than the signal itself if the latter has little energy at these frequencies. The ear perceives a high-frequency unmasked noise, which is all the more annoying since it often possesses a harmonic character. A simple correction of the slope of the filter is not adequate to model this energy difference adequately. Adaptation of the spectral expansion coefficients which takes into account the overall slope of the speech spectrum enables this problem to be handled better.

Preferably, the spectral parameters on the basis of which the value of at least one of the spectral expansion coefficients is adapted furthermore comprise at least one parameter representative of the resonant character of the short-term synthesis filter (LPC). A speech signal possesses up to four or five formants in the telephone band. These "humps" characterizing the outline of the spectrum are generally relatively rounded. However, LPC analysis may lead to filters which are close to instability. The spectrum corresponding to the LPC filter then includes relatively pronounced peaks which have large energy over a small bandwidth. The greater the masking, the closer the spectrum of the noise approaches the LPC spectrum. However, the presence of an energy peak in the noise distribution is very troublesome. This produces a distortion at formant level within a sizeable energy region in which the impairment becomes highly perceptible. The invention then makes it possible to reduce the level of masking as the resonant character of the LPC filter increases.

When the short-term synthesis filter is represented by line spectrum parameters or frequencies (LSP or LSF), the parameter representative of the resonant character of the short-term synthesis filter, on the basis of which the value of $\gamma_1$ and/or $\gamma_2$ is adapted, may be the smallest of the distances between two consecutive line spectrum frequencies.

DETAILED DESCRIPTION OF PREFERRED EMBODIMENTS

The invention is described below in its application to a CELP type speech coder. It will however be understood that it is also applicable to other types of analysis-by-synthesis coders (MP-LPC, VSELP . . . ).

Figure 1:
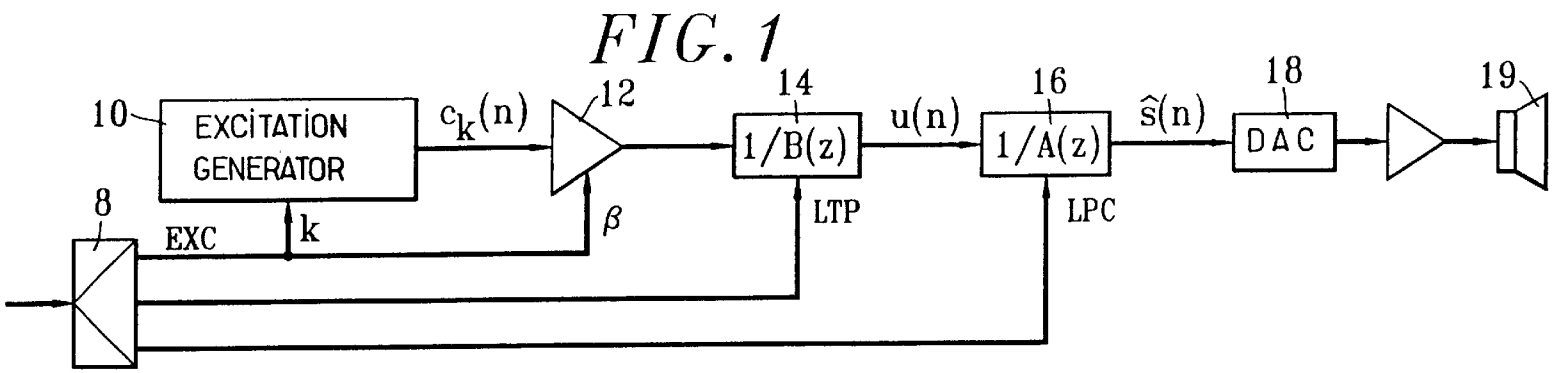
FIGS. 1 and 2 are schematical layouts of a CELP decoder and of a CELP coder capable of implementing the invention.

The speech synthesis process implemented in a CELP coder and a CELP decoder is illustrated in FIG. 1. An excitation generator 10 delivers an excitation code $c_k$ belonging to a predetermined codebook in response to an index k. An amplifier 12 multiplies this excitation code by an excitation gain $\beta$, and the resulting signal is subjected to a long-term synthesis filter 14. The output signal u from the filter 14 is in turn subjected to a short-term synthesis filter 16, the output $\hat{s}$ from which constitutes what is here regarded as the synthesized speech signal. Of course, other filters may also be implemented at decoder level, for example post-filters, as is well known in the field of speech coding.

The aforesaid signals are digital signals represented for example by 16-bit words at a sampling rate Fe equal for example to 8 kHz. The synthesis filters 14, 16 are in general purely recursive filters. The long-term synthesis filter 14 typically has a transfer function of the form $1/B(z)$ with $B(z)=1-Gz^{-T}$. The delay T and the gain G constitute long-term prediction (LTP) parameters which are determined adaptively by the coder. The LPC parameters of the short-term synthesis filter 16 are determined at the coder by linear prediction of the speech signal. The transfer function of the filter 16 is thus of the form $1/A(z)$ with $$A(z) = 1 - \sum_{i=1}^{p} a_i z^{-i}$$

in the case of linear prediction of order p (typically $p \approx 10$), $a_i$ representing the ith linear prediction coefficient.

Here, "excitation signal" designates the signal u(n) applied to the short-term synthesis filter 14. This excitation signal includes an LTP component $G \cdot u(n-T)$ and a residual component, or innovation sequence, $\beta C_k(n)$. In an analysis-by-synthesis coder, the parameters characterizing the residual component and, optionally, the LTP component are evaluated in closed loop, using a perceptual weighting filter.

Figure 2:
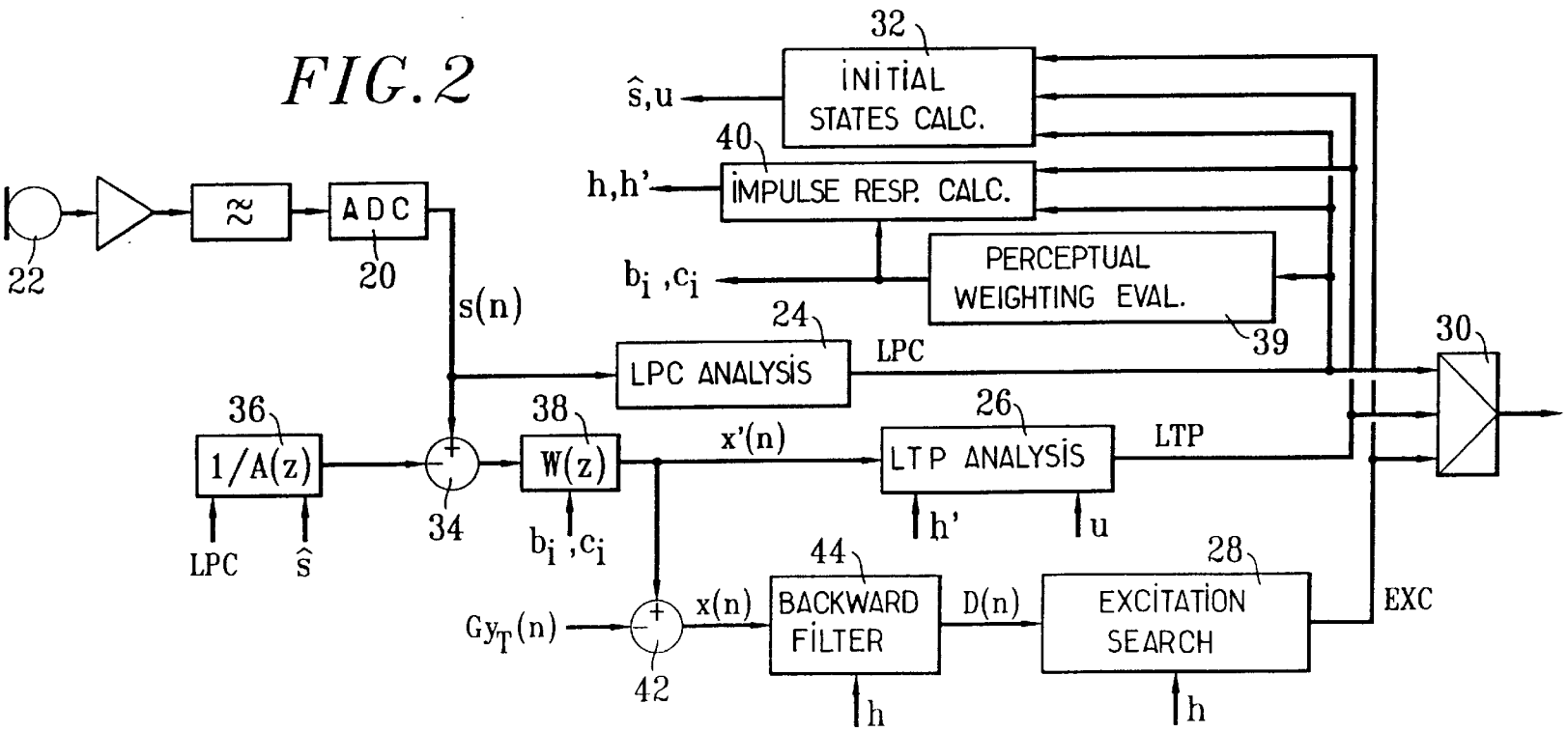

FIG. 2 shows the layout of a CELP coder. The speech signal s(n) is a digital signal, for example provided by an analogue/digital converter 20 which processes the amplified and filtered output signal of a microphone 22. The signal s(n) is digitized as successive frames of Λ samples which are themselves divided into sub-frames, or excitation frames, of L samples (for example Λ=240, L=40).

The LPC, LTP and EXC parameters (index k and excitation gain β) are obtained at coder level by three respective analysis modules 24, 26, 28. These parameters are next quantized in a known manner with a view to effective digital transmission, then subjected to a multiplexer 30 which forms the output signal from the coder. These parameters are also supplied to a module 32 for calculating initial states of certain filters of the coder. This module 32 essentially comprises a decoding chain such as that represented in FIG. 1. Like the decoder, the module 32 operates on the basis of the quantized LPC, LTP and EXC parameters. If an interpolation of the LPC parameters is performed at the decoder, as is commonly done, the same interpolation is performed by the module 32. The module 32 affords a knowledge, at coder level, of the earlier states of the synthesis filters 14, 16 of the decoder, which are determined on the basis of the synthesis and excitation parameters prior to the sub-frame under consideration.

In a first step of the coding process, the short-term analysis module 24 determines the LPC parameters (coefficients $a_i$ of the short-term synthesis filter) by analysing the short-term correlations of the speech signal s(n). This determination is performed for example once per frame of Λ samples, in such a way as to adapt to the changes in the spectral content of the speech signal. LPC analysis methods are well known in the art. Reference may for example be made to the work "Digital Processing of Speech Signals" by L. R. Rabiner and R. W. Shafer, Prentice-Hall Int., 1978. This work describes, in particular, Durbin's algorithm, which includes the following steps:

evaluation of p autocorrelations R(i) ($0 \leqq i < p$) of the speech signal s(n) over an analysis window embracing the current frame and possibly earlier samples if the length of the frame is small (for example 20 to 30 ms):

$$R(i) = \sum_{n=i}^{M-1} s^*(n) \cdot s^*(n-i)$$

with $M \geqq \Lambda$ and $s^*(n)=s(n)\cdot f(n)$, f(n) denoting a window function of length M, for example a rectangular function or a Hamming function;

recursive evaluation of the coefficients $a_i$:

E(0)=R(0)

For i going from 1 to p, do $$r_i = \left[ R(i) - \sum_{j=1}^{i-1} a_j^{(i-1)} \cdot R(i-j) \right] / E(i-1)$$

$$a_i^{(i)} = r_i$$

$$E(i) = (1 - r_i^2) \cdot E(i-1)$$

For j going from 1 to i−1, do $$a_j^{(i)} = a_j^{(i-1)} - r_i \cdot a_{i-j}^{(i-1)}$$

The coefficients $a_i$ are taken equal to the $a_i^{(P)}$ obtained in the latest iteration. The quantity E(p) is the energy of the residual prediction error. The coefficients $r_i$, lying between −1 and 1, are termed the reflection coefficients. They are often represented by the log-area-ratios $LAR_i=LAR(r_i)$, the function LAR being defined by $LAR(r)=\log_{10}[(1-r)/(1+r)]$.

The quantization of the LPC parameters can be performed over the coefficients $a_i$ directly, over the reflection coefficients $r_i$ or over the log-area-ratios $LAR_i$. Another possibility is to quantize line spectrum parameters (LSP standing for "line spectrum pairs", or LSF standing for "line spectrum frequencies"). The p line spectrum frequencies $\omega_i (1 \leqq i \leqq p)$, normalized between 0 and π, are such that the complex numbers 1, $\exp(j\omega_2)$, $\exp(j\omega_4)$, . . . , $\exp(j\omega_p)$, are the roots of the polynomial $P(z)=A(z)-z^{-(p+1)}A(z^{-1})$ and that the complex numbers $\exp(j\omega_1)$, $\exp(j\omega_3)$, . . . , $\exp(j\omega_{p-1})$, and −1 are the roots of the polynomial $Q(z)=A(z)+z^{-(p+1)}A(z^{-1})$. The quantization may be performed on the normalized frequencies $\omega_i$ or on their cosines.

The module 24 can perform the LPC analysis according to Durbin's classical algorithm, alluded to above in order to define the quantities $r_i$, $LAR_i$ and $\omega_i$ which are useful in implementing the invention. Other algorithms providing the same results, developed more recently, may be used advantageously, especially Levinson's split algorithm (see "A new Efficient Algorithm to Compute the LSP Parameters for Speech Coding", by S. Saoudi, J. M. Boucher and A. Le Guyader, Signal Processing, Vol. 28, 1992, pages 201–212), or the use of Chebyshev polynomials (see "The Computation of Line Spectrum Frequencies Using Chebyshev Polynomials", by P. Kabal and R. P. Ramachandran, IEEE Trans. on Acoustics, Speech, and Signal Processing, Vol. ASSP-34, No. 6, pages 1419–1426, December 1986).

The next step of the coding consists in determining the long-term prediction LTP parameters. These are for example determined once per sub-frame of L samples. A subtracter 34 subtracts the response of the short-term synthesis filter 16 to a null input signal from the speech signal s(n). This response is determined by a filter 36 with transfer function 1/A(z), the coefficients of which are given by the LPC parameters which were determined by the module 24, and the initial states ŝ of which are provided by the module 32 in such a way as to correspond to the last p samples of the synthetic signal. The output signal from the subtracter 34 is subjected to a perceptual weighting filter 38 whose role is to emphasise the portions of the spectrum in which the errors are most perceptible, i.e. the inter-formant regions.

The transfer function W(z) of the perceptual weighting filter is of the general form: $W(z)=A(z/\gamma_1)/A(z/\gamma_2)$, $\gamma_1$ and $\gamma_2$ being two spectral expansion coefficients such that $0 \leqq \gamma_2 \leqq \gamma_1 \leqq 1$. The invention proposes to dynamically adapt the values of $\gamma_1$ and $\gamma_2$ on the basis of spectral parameters determined by the LPC analysis module 24. This adaptation is carried out by a module 39 for evaluating the perceptual weighting, according to a process described further on.

The perceptual weighting filter may be viewed as the succession in series of an all-pole filter of order p, with transfer function:

$$1/A(z/\gamma_2) = 1/\left[ \sum_{i=0}^{p} b_i z^{-i} \right]$$

with $b_0=1$ and $b_i=-a_i\gamma_2^{\,i}$ for $0<i \leqq p$ and of an all-zero filter of order p, with transfer function $$A(z/\gamma_1)=\sum_{i=0}^{p} c_i z^{-i}$$

with $c_0=1$ and $c_i=-a_i\gamma_1^{\,i}$ for $0<i\leqq p$. The module 39 thus calculates the coefficients $b_i$ and $c_i$ for each frame and supplies them to the filter 38.

The closed-loop LTP analysis performed by the module 26 consists, in a conventional manner, in selecting for each sub-frame the delay T which maximizes the normalized correlation:

$$\left[\sum_{n=0}^{L-1} x'(n)\cdot y_T(n)\right]^2 \Big/ \left[\sum_{n=0}^{L-1} [y_T(n)]^2\right]$$

where x' (n) denotes the output signal from the filter 38 during the relevant sub-frame, and $y_T(n)$ denotes the convolution product u(n−T)*h'(n). In the above expression, h'(0), h'(1), . . . , h'(L−1) denotes the impulse response of the weighted synthesis filter, with transfer function W(z) /A(z). This impulse response h' is obtained by a module 40 for calculating impulse responses, on the basis of the coefficients $b_i$ and $c_i$ supplied by the module 39 and the LPC parameters which were determined for the sub-frame, if need be after quantization and interpolation. The samples u(n−T) are the earlier states of the long-term synthesis filter 14, as provided by the module 32. In respect of the delays T which are less than the length of a sub-frame, the missing samples u(n−T) are obtained by interpolation on the basis of the earlier samples, or from the speech signal. The delays T, integer or fractional, are selected from a specified window, ranging for example from 20 to 143 samples. To reduce the closed-loop search range, and hence to reduce the number of convolutions $y_T(n)$ to be calculated, it is possible firstly to determine an open-loop delay T' for example once per frame, and then to select the closed-loop delays for each sub-frame in a reduced interval around T'. The open-loop search consists more simply in determining the delay T' which maximizes the autocorrelation of the speech signal s(n), possibly filtered by the inverse filter with transfer function A(z). Once the delay T has been determined, the long-term prediction gain G is obtained through:

$$G=\left[\sum_{n=0}^{L-1} x'(n)\cdot y_T(n)\right] \Big/ \left[\sum_{n=0}^{L-1} [y_T(n)]^2\right]$$

In order to search for the CELP excitation relating to a sub-frame, the signal $Gy_T(n)$, which was calculated by the module 26 in respect of the optimal delay T, is firstly subtracted from the signal x'(n) by the subtracter 42. The resulting signal x(n) is subjected to a backward filter 44 which provides a signal D(n) given by:

$$D(n)=\sum_{i=n}^{L-1} x(i)\cdot h(i-n)$$

where h(0), h(1), . . . , h(L−1) denotes the impulse response of the compound filter made up of the synthesis filters and of the perceptual weighting filter, this response being calculated by the module 40. In other words, the compound filter has transfer function W(z)/[A(z)·B(z)].

In matrix notation, we therefore have:

$$D=(D(0), D(1), \ldots, D(L-1))=x\cdot H$$

with $$x=(x(0), x(1), \ldots, x(L-1))$$

$$\text{and } H=\begin{pmatrix} h(0) & 0 & \cdots & & 0 \\ h(1) & h(0) & \cdots & & \\ \vdots & \vdots & & & \vdots \\ h(L-1) & & & h(0) & 0 \\ h(L-1) & h(L-2) & \cdots & h(1) & h(0) \end{pmatrix}$$

The vector D constitutes a target vector for the excitation search module 28. This module 28 determines a codeword from the codebook which maximizes the normalized correlation $P_k^2/\alpha_k^2$ in which:

$$P_k=D\cdot c_k^T$$

$$\alpha_k^2=c_k\cdot H^T\cdot H\cdot c_k^T=c_k\cdot U\cdot c_k^T$$

The optimal index k having been determined, the excitation gain β is taken equal to $\beta=P_k/\alpha_k^2$.

With reference to FIG. 1, the CELP decoder comprises a demultiplexer 8 receiving the binary stream output by the coder. The quantized values of the EXC excitation parameters and of the LTP and LPC synthesis parameters are supplied to the generator 10, to the amplifier 12 and to the filters 14, 16 in order to reconstruct the synthetic signal ŝ, which may for example be converted into analogue by the converter 18 before being amplified and then applied to a loudspeaker 19 in order to restore the original speech.

The spectral parameters on the basis of which the coefficients $\gamma_1$ *1 and* $\gamma_2$ are adapted comprise on the one hand the first two reflection coefficients $r_1=R(1)/R(0)$ and $r_2=[R(2)-r_1R(1)]/[(1-r_1^2)R(0)]$, which are representative of the overall slope of the speech spectrum, and on the other hand the line spectrum frequencies, whose distribution is representative of the resonant character of the short-term synthesis filter. The resonant character of the short-term synthesis filter increases as the smallest distance $d_{min}$ between two line spectrum frequencies decreases. The frequencies $\omega_i$ being obtained in ascending order ($0<\omega_1<\omega_2<\ldots<\omega_p<\pi$), we have:

$$d_{min}=\min_{1\leqq i<p} (\omega_{i+1}-\omega_i)$$

By stopping at the first iteration of Durbin's algorithm alluded to above, a rough approximation of the speech spectrum is produced through a transfer function $1/(1-r_1\cdot z^{-1})$. The overall slope (usually negative) of the synthesis filter therefore tends to increase in absolute value as the first reflection coefficient $r_1$ approaches 1. If the analysis is continued to order 2 by adding an iteration, a less rough modelling is achieved, with a filter of order 2 with transfer function $1/[1-(r_1-r_1r_2)\cdot z^{-1}-r_2\cdot z^{-2})]$. The low-frequency resonant character of this filter of order 2 increases as its poles approach the unit circle, i.e. as $r_1$ tends to 1 and $r_2$ tends to −1. It may therefore be concluded that the speech spectrum has relatively large energy in the low frequencies (or alternatively a relatively big negative overall slope) as $r_1$ approaches 1 and $r_2$ approaches −1.

It is known that a formant peak in the speech spectrum leads to the bunching together of several line spectrum frequencies (2 or 3), whereas a flat part of the spectrum corresponds to a uniform distribution of these frequencies.

The resonant character of the LPC filter therefore increases as the distance $d_{min}$ decreases.

In general, greater masking is adopted (a larger gap between $\gamma_1$ and $\gamma_2$) as the low-pass character of the synthesis filter increases ($r_1$ approaches 1 and $r_2$ approaches −1), and/or as the resonant character of the synthesis filter decreases ($d_{min}$ increases).

Figure 3:
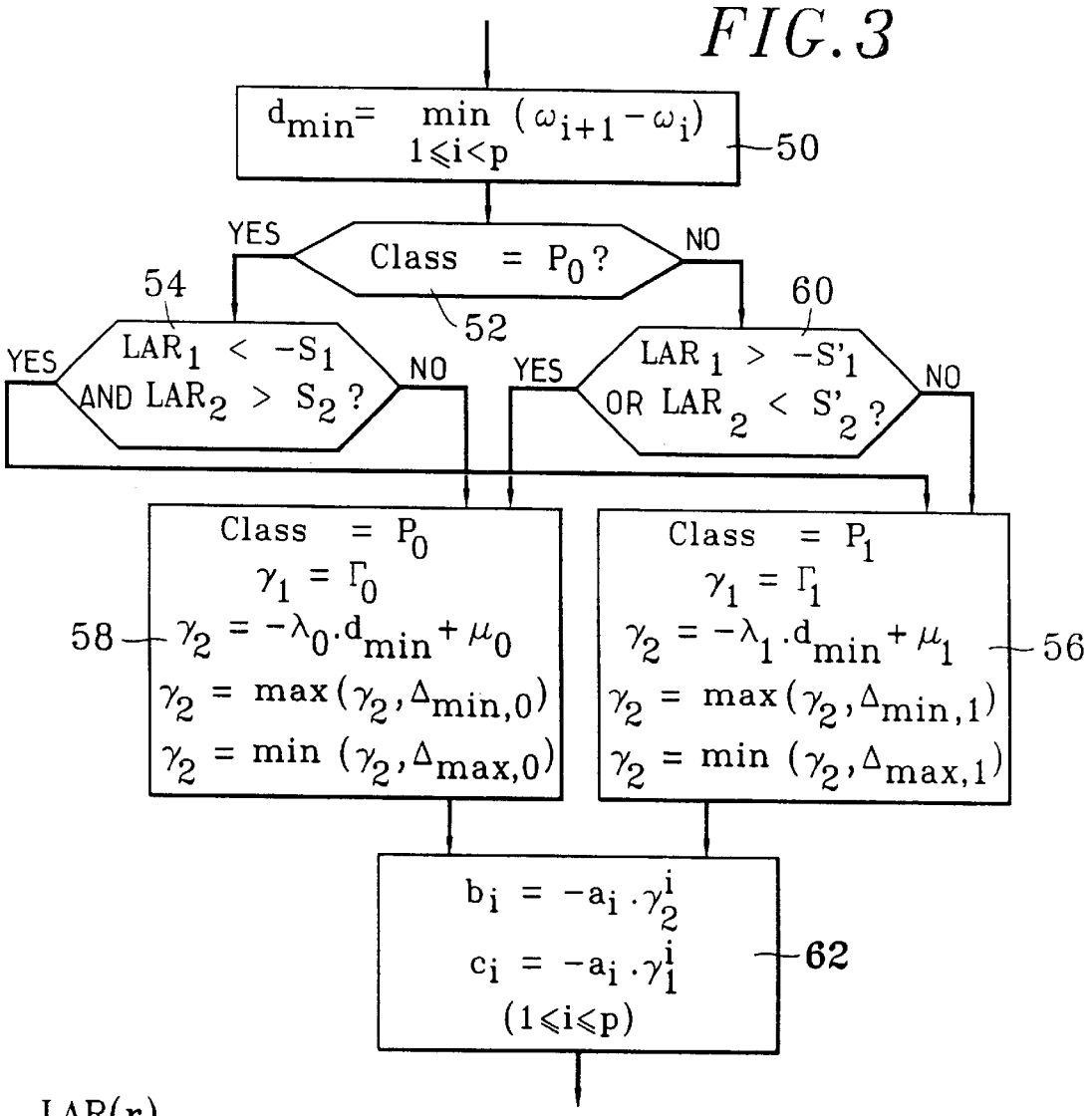
FIG. 3 is a flowchart of a procedure for evaluating the perceptual weighting.

FIG. 3 shows an examplary flowchart for the operation performed at each frame by the module 39 for evaluating the perceptual weighting.

At each frame, the module 39 receives the LPC parameters $a_i$, $r_i$ (or $LAR_i$) and $\omega_i$ ($1 \leqq i \leqq p$) from the module 24. In step 50, the module 39 evaluates the minimum distance $d_{min}$ between two consecutive line spectrum frequencies by minimizing $\omega_{i+1}-\omega_i$ for $1 \leqq i < p$.

On the basis of the parameters representative of the overall slope of the spectrum over the frame ($r_1$ and $r_2$), the module 39 performs a classification of the frame among N classes $P_0, P_1, \ldots, P_{N-1}$. In the example of FIG. 3, N=2. Class $P_1$ corresponds to the case in which the speech signal s(n) is relatively energetic at the low frequencies ($r_1$ relatively close to 1 and $r_2$ relatively close to −1). Hence, greater masking will generally be adopted in class $P_1$ than in class $P_0$.

Figure 4:
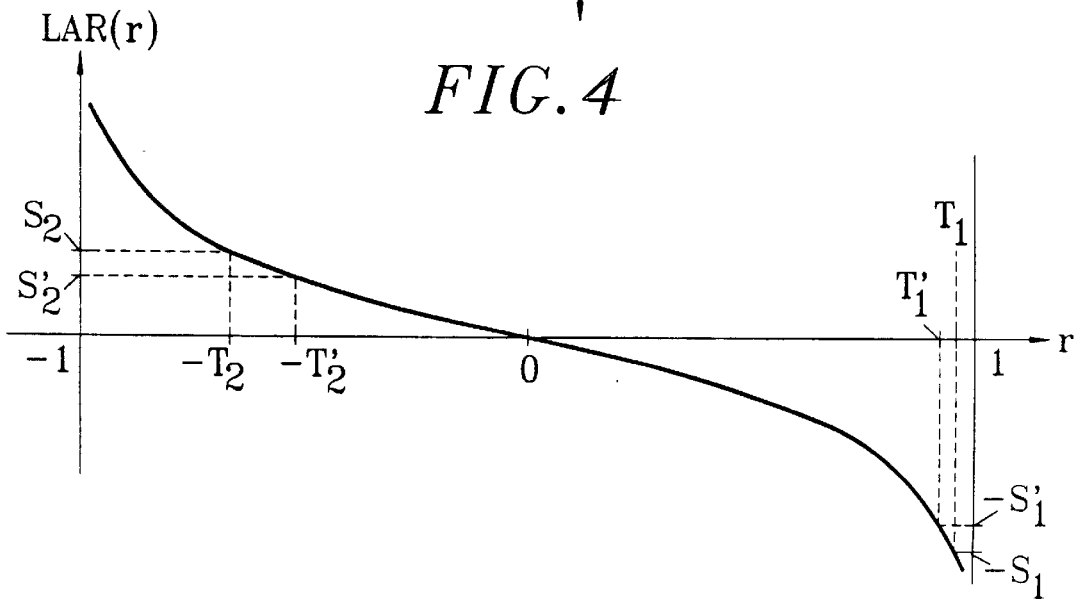
FIG. 4 shows a graph of the function $\log[(1-r)/(1+r)]$.

To avoid excessively frequent transitions between classes, some hysteresis is introduced on the basis of the values of $r_1$ and $r_2$. Provision may thus be made for class $P_1$ to be selected from each frame for which $r_1$ is greater than a positive threshold $T_1$ and $r_2$ is less than a negative threshold $-T_2$, and for class $P_0$ to be selected from each frame for which $r_1$ is less than another positive threshold $T_1'$ (with $T_1'<T_1$) or $r_2$ is greater than another negative threshold $-T_2'$ (with $T_2'<T_2$). Given the sensitivity of the reflection coefficients around ±1, this hysteresis is easier to visualize in the domain of log-area-ratios LAR (see FIG. 4) in which the thresholds $T_1$, $T_1'$, $-T_2$, $-T_2'$ correspond to respective thresholds $-S_1$, $-S_1'$, $S_2$, $S_2'$.

On initialization, the default class is for example that for which masking is least ($P_0$).

In step 52, the module 39 examines whether the preceding frame came under class $P_0$ or under class $P_1$. If the preceding frame was class $P_0$, the module 39 tests, at 54, the condition $\{LAR_1<-S_1 \text{ and } LAR_2>S_2\}$ or, if the module 24 supplies the reflection coefficients $r_1$, $r_2$ instead of the log-area-ratios $LAR_1$, $LAR_2$, the equivalent condition $\{r_1>T_1 \text{ and } r_2<-T_2\}$. If $LAR_1<-S_1$ and $LAR_2>S_2$, a transition is performed into class $P_1$ (step 56). If the test 54 shows that $LAR_1 \geqq -S_1$ or $LAR_2 \leqq S_2$, the current frame remains in class $P_0$ (step 58).

If step 52 shows that the preceding frame was class $P_1$, the module 39 tests, at 60, the condition $\{LAR_1 \leqq -S_1' \text{ or } LAR_2<S_2'\}$ or, if the module 24 supplies the reflection coefficients $r_1$, $r_2$ instead of the log-area-ratios $LAR_1$, $LAR_2$, the equivalent condition $\{r_1<T_1' \text{ or } r_2>-T_2'\}$. If $LAR_1>-S_1'$ or $LAR_2<S_2'$, a transition is performed into class $P_0$ (step 58). If the test 60 shows that $LAR_1 \leqq -S_1'$ and $LAR_2 \geqq S_2'$, the current frame remains in class $P_1$ (step 56).

In the example illustrated by FIG. 3, the larger $\gamma_1$ of the two spectral expansion coefficients has a constant value $\Gamma_0$, $\Gamma_1$ in each class $P_0$, $P_1$, with $\Gamma_0 \leqq \Gamma_1$, and the other spectral expansion coefficient $\gamma_2$ is a decreasing affine function of the minimum distance $d_{min}$ between the line spectrum frequencies: $\gamma_2=-\lambda_0 \cdot d_{min}+\mu_0$ in class $P_0$ and $\gamma_2=-\lambda_1 \cdot d_{min}+\mu_1$ in class $P_1$, with $\lambda_0 \geqq \lambda_1 \geqq 0$ and $\mu_1 \geqq \mu_0 \geqq 0$. The values of $\gamma_2$ can also be bounded so as to avoid excessively abrupt variations: $\Delta_{min,0} \leqq \gamma_2 \leqq \Delta_{max,0}$ in class $P_0$ and $\Delta_{min,1} \leqq \gamma_2 \leqq \Delta_{max,1}$ in class $P_1$. Depending on the class picked out for the current frame, the module 39 assigns the values of $\gamma_1$ and $\gamma_2$ in step 56 or 58, and then calculates the coefficients $b_i$ and $c_i$ of the perpetual weighting factor in step 62.

As mentioned previously, the frames of Λ samples over which the module 24 calculates the LPC parameters are often subdivided into sub-frames of L samples for determination of the excitation signal. In general, an interpolation of the LPC parameters is performed at sub-frame level. In this case, it is advisable to implement the process of FIG. 3 for each sub-frame, or excitation frame, with the aid of the interpolated LPC parameters.

The applicant has tested the process for adapting the coefficients $\gamma_1$ and $\gamma_2$ in the case of an algebraic codebook CELP coder operating at 8 kbits/s, and for which the LPC parameters are calculated at each 10 ms frame (Λ=80). The frames are each divided into two 5 ms sub-frames (L=40) for the search for the excitation signal. The LPC filter obtained for a frame is applied for the second of these sub-frames. For the first sub-frame, an interpolation is performed in the LSF domain between this filter and that obtained for the preceding frame. The procedure for adapting the masking level is applied at the rate of the sub-frames, with an interpolation of the LSF $\omega_i$ and of the reflection coefficients $r_1$, $r_2$ for the first sub-frames. The procedure illustrated by FIG. 3 has been used with the numerical values: $S_1=1.74$; $S'_1=1.52$; $S_2=0.65$; $S_2'=0.43$; $\Gamma_0=0.94$; $\lambda_0=0$; $\mu_0=0.6$; $\Gamma_1=0.98$; $\lambda_1=6$; $\mu_1=1$; $\Delta_{min,1}=0.4$; $\Delta_{max,1}=0.7$, the frequencies $\omega_i$ being normalized between 0 and π.

This adaptation procedure, with negligible extra complexity and no great structural modification of the coder, has made it possible to observe a significant improvement in the subjective quality of coded speech.

The applicant has also obtained favourable results with the processes of FIG. 3 applied to a (low delay) LD-CELP coder with variable bit rate of between 8 and 16 kbits/s. The slope classes were the same as in the preceding case, with $\Gamma_0=0.98$; $\lambda_0=4$; $\mu_0=1$; $\Delta_{min,0}=0.6$; $\Delta_{max,0}=0.8$; $\Gamma_1=0.98$; $\lambda_1=6$; $\mu_1=1$; $\Delta_{min,1}=0.2$; $\Delta_{max,1}=0.7$.

I claim:

1. Analysis-by-synthesis speech coding method, comprising the following steps:

linear prediction analysis of order p of a speech signal digitized as successive frames in order to determine parameters defining a short-term synthesis filter ;

determination of excitation parameters defining an excitation signal to be applied to the short-term synthesis filter in order to produce a synthetic signal representative of the speech signal, some at least of the excitation parameters being determined by minimizing the energy of an error signal resulting from a filtering of a difference between the speech signal and the synthetic signal by at least one perceptual weighting filter having a transfer function of the form $W(z)=A(z/\gamma_1)/A(z/\gamma_2)$ where $$A(z) = 1 - \sum_{i=1}^{p} a_i z^{-i}$$

the coefficients $a_i$ being linear prediction coefficients obtained in the linear prediction analysis step, and $\gamma_1$ and $\gamma_2$ denoting spectral expansion coefficients such that $0 \leqq \gamma_2 \leqq \gamma_1 \leqq 1$; and production of quantization values of the parameters defining the short-term synthesis filter and of the excitation parameters, wherein the value of at least one of the spectral expansion coefficients is adapted on the basis of spectral parameters obtained in the linear prediction analysis step.

2. Method according to claim 1, wherein the spectral parameters on the basis of which the value of at least one of the spectral expansion coefficients is adapted comprise at least one parameter representative of the overall slope of the spectrum of the speech signal and at least one parameter representative of a resonant character of the short-term synthesis filter.

3. Method according to claim 2, wherein said parameters representative of the overall slope of the spectrum comprise first and second reflection coefficients determined during the linear prediction analysis step.

4. Method according to claim 2, wherein said parameter representative of the resonant character is the smallest of the distances between two consecutive line spectrum frequencies.

5. Method according to claim 2, further comprising performing a classification of the frames of the speech signal among several classes on the basis of the parameter or parameters representative of the overall slope of the spectrum, wherein, for each class, values of the two spectral expansion coefficients are adopted such that their difference $\gamma_1-\gamma_2$ decreases as the resonant character of the short-term synthesis filter increases.

6. Method according to claim 5, wherein said parameters representative of the overall slope of the spectrum comprise first and second reflection coefficients determined during the linear prediction analysis step, wherein there are provided two classes selected on the basis of the values of the first reflection coefficient $r_1=R(1)/R(0)$ and of the second reflection coefficient $r_2=[R(2)-r_1\cdot R(1)]/[(1-r_1^2)\cdot R(0)]$, R(j) denoting an auto-correlation of the speech signal for a delay of j samples, wherein the first class is selected from each frame for which the first reflection coefficient is greater than a first positive threshold and the second reflection coefficient is less than a first negative threshold, and wherein the second class is selected from each frame for which the first reflection coefficient is less than a second positive threshold less than the first positive threshold or the second reflection coefficient is greater than a second negative threshold less in absolute value than the first negative threshold.

7. Method according to claim 5, wherein said parameter representative of the resonant character is the smallest of the distances between two consecutive line spectrum frequencies, and wherein, in each class, the largest $\gamma_1$ of the spectral expansion coefficients is fixed and the smallest $\gamma_2$ of the spectral expansion coefficients is a decreasing affine function of the smallest of the distances between two consecutive line spectrum frequencies.

* * * * *